US005549245A

United States Patent [19]

Kish

[11] Patent Number: 5,549,245

[45] **Date of Patent: *Aug. 27, 1996**

[54] COMPOSITE PAD USEFUL BETWEEN RAILROAD RAIL AND RAILROAD TIE

[75] Inventor: Frederick A. Kish, Wheeling, Ill.

[73] Assignee: Illinois Tool Works Inc., Glenview, Ill.

[ * ] Notice: The term of this patent shall not extend beyond the expiration date of Pat. No. 5,551,633.

[21] Appl. No.: 333,522

[22] Filed: Nov. 2, 1994

[51] Int. Cl.[6] ..... E01B 9/62

[52] U.S. Cl. ..... 238/283

[58] Field of Search ..... 238/264, 265, 238/269, 283, 287

[56] References Cited

U.S. PATENT DOCUMENTS

| | | | |
|---|---|---|---|
| 1,772,875 | 8/1930 | O'Brien . | |
| 4,104,483 | 8/1978 | Seely | 174/138 |
| 4,313,563 | 2/1982 | Young | 238/349 |
| 4,325,511 | 4/1982 | Young | 238/349 |
| 4,494,463 | 1/1985 | Young et al. | 104/17 A |
| 4,540,637 | 9/1985 | Geary et al. | 428/626 |
| 4,566,631 | 1/1986 | Brown | 238/349 |
| 4,757,945 | 7/1988 | Leeves | 238/107 |
| 4,771,944 | 9/1988 | Brister et al. | 238/283 |
| 4,925,094 | 5/1990 | Buekett | 238/265 |
| 4,971,247 | 11/1990 | Harkus | 238/283 |
| 5,011,077 | 4/1991 | Hodgson et al. | 238/283 |
| 5,098,959 | 4/1992 | McGrath et al. | 525/299 |
| 5,110,046 | 5/1992 | Young | 238/283 |
| 5,165,346 | 11/1992 | Piekarski | 104/17.2 |
| 5,173,222 | 12/1992 | Young et al. | 264/35 |
| 5,195,679 | 3/1993 | Leeves et al. | 238/283 |
| 5,203,502 | 4/1993 | Young | 238/283 |
| 5,249,743 | 10/1993 | Leingang et al. | 238/283 |
| 5,261,599 | 11/1993 | Brown | 238/283 |
| 5,346,131 | 9/1994 | Meier et al. | 238/283 |

FOREIGN PATENT DOCUMENTS

| | | |
|---|---|---|
| 541884 | 5/1993 | European Pat. Off. . |
| 2086643 | 12/1971 | France . |
| 777189 | 6/1957 | United Kingdom . |
| 1496390 | 12/1977 | United Kingdom . |
| 1549623 | 8/1979 | United Kingdom . |
| 1554160 | 10/1979 | United Kingdom . |
| 2121461 | 12/1983 | United Kingdom . |
| 2237833 | 5/1991 | United Kingdom . |

OTHER PUBLICATIONS

"Engineering Materials and Their Applications: Third Edition"; Flinn et al; Houghton Mifflin Company; Boston; pp. 375–376 & 398–399.

*Primary Examiner*—S. Joseph Morano

*Attorney, Agent, or Firm*—Dressler, Goldsmith, Milnamow & Katz, Ltd.

[57] ABSTRACT

In a railroad track, a composite pad is useful between a lower flange of a railroad rail and an upper surface of a railroad tie, particularly but not exclusively a concrete tie. The composite pad comprises a bonding member, preferably a plate made from galvanized, powder-coated steel and a polyurethane pad. Such a plate, if used, may be powder-coated with a composition comprising a polyester, acrylic, or epoxy resin. The pad is cast onto the member so that the member is bonded directly to the pad. An adhesive layer comprising a methacrylate ester composition bonds the member to the upper surface of the tie, at the lower surface of the member, so as to resist relative movement between the member and the tie and so as to retard infiltration of sand, water, or debris therebetween.

14 Claims, 1 Drawing Sheet

COMPOSITE PAD USEFUL BETWEEN RAILROAD RAIL AND RAILROAD TIE

TECHNICAL FIELD OF THE INVENTION

This invention pertains to a system employing a composite pad between a lower flange of a railroad rail and a railroad tie, particularly but not exclusively a concrete tie, and preferably with an adhesive layer bonding the composite pad to the railroad tie. The composite pad comprises an elastomeric pad, such as a polyurethane pad, to underlie the railroad rail and a bonding member, such as a galvanized, powder-coated, steel plate, to overlie the railroad tie. Preferably, a methacrylate ester is used for the adhesive layer.

BACKGROUND OF THE INVENTION

Commonly, metal clips or clamps that engage embedded supports are used for securing steel railroad rails to concrete railroad ties, and non-conducting insulators are used to insulate the clips or clamps from the railroad rails. Metal clips or clamps of a type exemplified in Leeves U.S. Pat. No. 4,757,945 and available commercially from Pandrol Limited of London, England, and metal clips or clamps of a type exemplified in Young U.S. Pat. No. 5,110,046 and available commercially from McKay Australia Limited of Maidstone, Australia, are used widely in North America.

Commonly, when such clips are used, elastomeric pads are disposed between the lower flanges of the railroad rails and the railroad ties for cushioning the railroad rails and for insulating the rails electrically from the ties and from other underlying structures. Although ethylene vinyl acetate (EVA) rubber and other pads have been used widely for many years, polyurethane pads offering superior performance have become available commercially from ITW Irathane (a unit of Illinois Tool Works Inc.) of Hibbing, Minn., under its IRATHANE trademark.

Deterioration of the elastomeric pads and erosion of the concrete ties can occur if water infiltrates and freezes between the pads and the ties or if sand, which is used commonly to increase traction on grades, or debris infiltrates therebetween. Such deterioration and erosion problems can be quite severe, particularly under high loadings, in regions where weather conditions vary widely from summer to winter, at sharp curves, and at steep grades. Such deterioration and erosion problems can result in so-called "tie seat abrasion", which if severe can result in a railroad tie being judged unsafe for further service in a railroad track and having to be replaced.

Prior efforts to address such deterioration and erosion problems are disclosed in Buekett U.S. Pat. No. 4,925,094. As disclosed therein, a stainless steel or other non-corrodible metal or plastic plate is cast into an upper surface of a concrete tie. A rubber or plastic pad is interposed between the lower flange of a railroad rail and the plate that has been cast into the tie. It appears that the pad merely rests upon the plate and is free to move relative to the cast-in-place plate.

Other efforts to address such deterioration and erosion problems are disclosed in Young U.S. Pat. No. 5,110,046. As disclosed therein, either an abrasion-resistant plate of an unspecified material is bonded to the upper surface of a concrete tie by an adhesive layer, epoxy resin adhesives being preferred, or a high density polyethylene (HDPE) closed cell foam is interposed between the abrasion-resistant plate and the upper surface of the concrete tie. In either instance, a rubber, polyurethane, or other elastomeric pad is interposed between the lower flange of a railroad rail and the upper surface of the concrete tie. It appears that the elastomeric pad merely rests upon the plate and is free to move relative to the adhesively bonded or foam-separated plate.

As a matter of related interest, Brown U.S. Pat. No. 5,261,599 discloses an elastomeric pad having resiliently deformable sealing portions, which are intended to form a watertight seal between the pad and the upper Surface of a railroad tie, such as a concrete tie.

SUMMARY OF THE INVENTION

Addressing such deterioration and erosion problems in a novel manner, this invention provides a composite pad that may be advantageously used between the lower flange of a railroad rail and the upper surface of a railroad tie, particularly but not exclusively a concrete tie, and that may be adhesively bonded to the railroad tie.

Broadly, the composite pad comprises an elastomeric pad and a bonding member, such as a steel or other plate. The elastomeric pad has an upper surface underlying and engaging the lower flange of the railroad rail. The bonding member has an upper surface bonded to the lower surface of the elastomeric pad so as to resist relative movement between the elastomeric pad and the bonding member. The bonding member may be also characterized as a tie layer.

An adhesive layer, for which a methacrylate ester composition is preferred, is useful for bonding the bonding member to the upper surface of the railroad tie, at the lower surface of the bonding member, so as to resist relative movement between the bonding member and the railroad tie and so as to retard infiltration of sand, water, or debris between the bonding member and the railroad tie.

The elastomeric pad can be made from any of several compositions depending upon he very specific needs of the application, as determined by the environmental factors, as well as the loadings and frequency of loadings of the specific rail line. The pad can be thus made from a thermoplastic material, such as EVA, polyurethane, or other elastomeric material available. However, the pad must be capable of being bonded to a bonding member of suitable composition. Bonding can occur via insert molding, if the pad is injection molded, via adhesive bonding, via thermally laminating a suitable material for the bonding member, or via casting a liquid onto the bonding member and polymerizing it in place.

Preferably, the elastomeric pad is a polyurethane pad, which is cast onto the separating plate so that the separating plate is bonded directly to the polyurethane pad. For certain manufacturing purposes, it is desirable for the bonding member to be slightly smaller in all dimensions than the overall pad, such that the bonding member is located in a recess in the elastomeric pad. Alternatively, the bonding member can constitute the entire lower surface of the composite pad or can be actually larger than the elastomeric pad so as to extend beyond one or more of the edges of the elastomeric pad.

The bonding member can be made from any of several compositions with the key factors being its ability to be initially bonded to the elastomeric pad and to be subsequently bonded to the railroad tie with a suitable adhesive. As the bonding member, a steel plate can be used, which has been appropriately surface-treated in ways known to those skilled in the art, such as with a coating of iron phosphate or zinc phosphate with or without a chrome sealer.

Since the edges of the steel plate can be exposed to severe environmental stresses, it is desirable for the steel plate to be corrosion resistant. It is well known to provide a zinc coating (galvanization) on steel to provide for improve corrosion resistance. Therefore, the bonding member may be a steel plate, which has been galvanized.

Further improvements in corrosion resistance can be achieved by coating the galvanized plate with an organic barrier coating, such as a paint. Additionally, corrosion resistance can be obtained if the organic barrier coating is a powder coating selected from epoxy, polyester, or acrylic compositions. As an example, the bonding member may be a relatively thick (e.g. 30 mil) plate of galvanized, powder-coated steel.

Alternatively, the bonding member can be made from a polymeric material. If a polymeric material is used, the bonding member may be a relatively thick plate or a relatively thin film, such as a 5 mil (0.005 inch) polycarbonate film.

These and other objects, features, and advantages of this invention are evident from the following description of two alternative embodiments of this invention with reference to the accompanying drawings.

DETAILED DESCRIPTION OF ILLUSTRATED EMBODIMENTS

Figure 1:
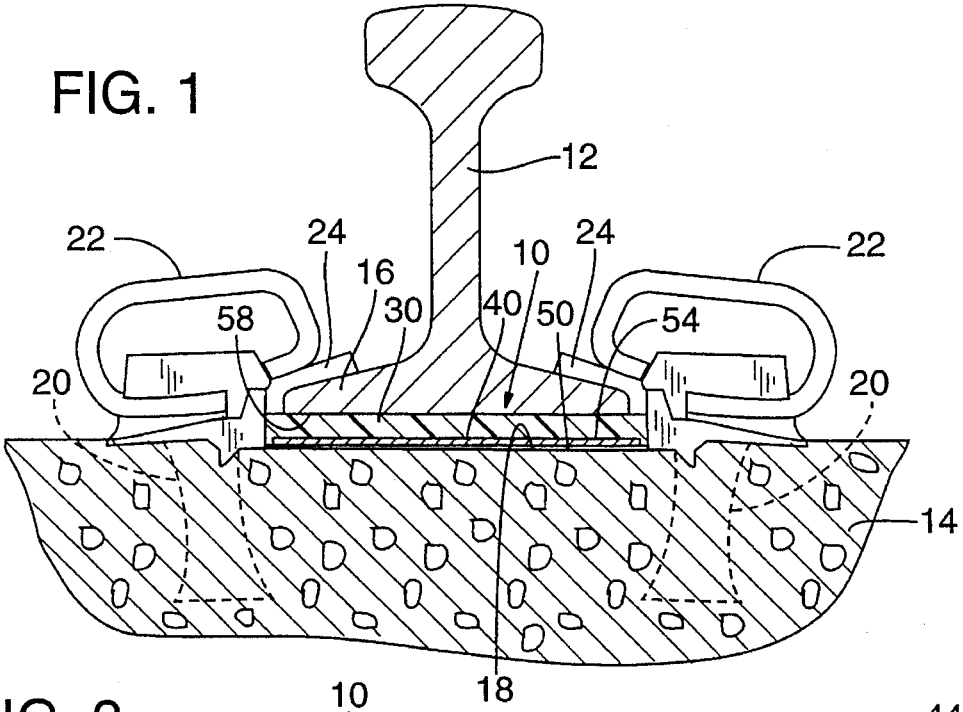
FIG. 1 is a fragmentary, cross-sectional view of a railroad rail having a lower flange, a railroad tie made from concrete, and a composite pad according to a first embodiment of this invention, together with associated clips, supports, and insulators.

As shown in FIG. 1, a composite pad 10 according to a first embodiment of this invention is mounted between a railroad rail 12 made from steel and a railroad tie 14 made from concrete. As mounted between a lower flange 16 of the railroad rail 12 and an upper surface 18 of the concrete tie 14, the composite pad 10 cushions the railroad rail 12 and insulates the railroad rail 12 electrically from the concrete tie 14.

Two supports 20 are embedded in the concrete tie 14 and extend upwardly from the upper surface 18. Two clamps 22 are provided, each engaging one of the supports 20 and pressing against one side of the lower flange 16 of the railroad rail 12, via an insulator 24 bearing on the composite pad 10, so as to secure the railroad rail 12 to the concrete tie 14.

Figure 2:
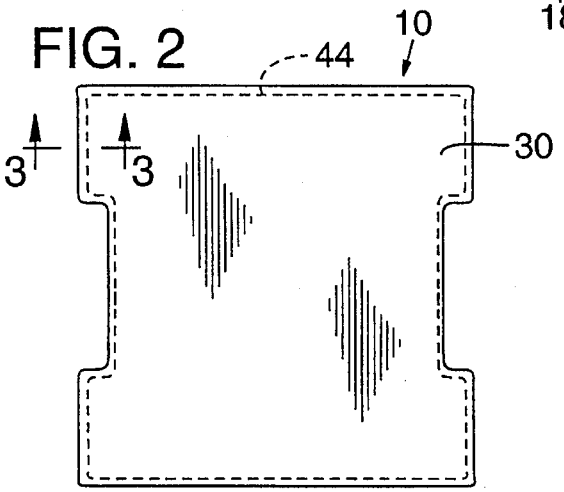
FIG. 2 is a plan view of the composite pad according to the first embodiment shown in FIG. 1.
Figure 4:
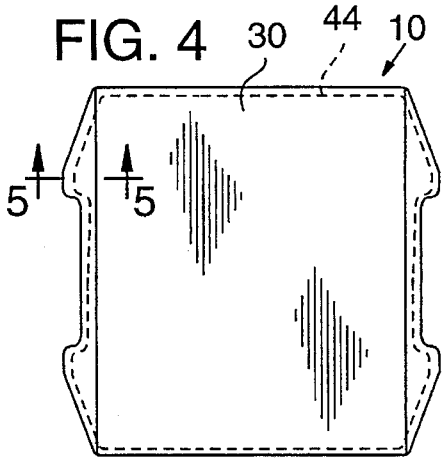
FIG. 4 is a plan view of a composite pad according to a second embodiment of this invention.
Figure 3:
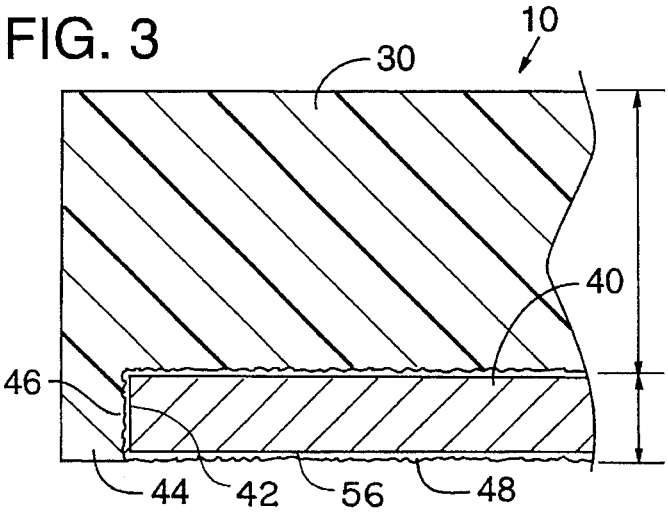
FIG. 3 is a greatly enlarged, fragmentary sectional view taken along line 3—3 of FIG. 2, in a direction indicated by arrows.
Figure 5:
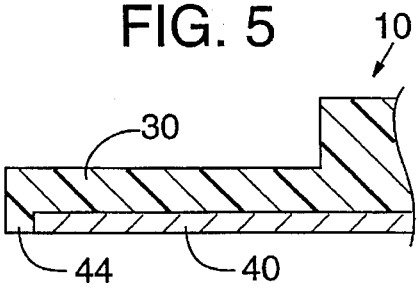
FIG. 5 is a somewhat enlarged, fragmentary sectional view taken along line 5—5 of FIG. 4, in a direction indicated by arrows.

In the first embodiment shown in FIGS. 1, 2 and 3, the composite pad 10 is configured to coact with the supports 20, clamps 22, and insulators 24, which are outside the scope of this invention and which may be substantially similar to known supports, clamps, and insulators that are available commercially from Pandrol Limited, supra, and that are exemplified in Leeves U.S. Pat. No. 4,757,945. In the second embodiment shown in FIGS. 4 and 5, the composite pad 10 is configured to coact with known supports, clamps, and insulators (not shown) that are available commercially from McKay Australia Limited, supra, and that are exemplified in Young U.S. Pat. No. 5,110,046. In either embodiment, the composite pad 10 is intended to be adhesively bonded to a railroad tie, such as the concrete tie 14.

In each illustrated embodiment, the composite pad 10 comprises a polyurethane pad 30 and a bonding member 40, which is bonded directly to the elastomeric pad 30 and which is to be adhesively bonded to a railroad tie, such as the concrete tie 14. Preferably, the polyurethane pad 30 is a similar to the polyurethane pads that have become available commercially from ITW Irathane, supra, except that the polyurethane pad 30 is cast onto the bonding member 40 so that the bonding member 40 is bonded directly to the polyurethane pad 30. Preferably, the bonding member 40 is made from steel, galvanized, and powder-coated. Alternatively, the bonding member 40 is made from a polymeric material.

As in each illustrated embodiment, the bonding member 40 may be located in a recess 42 in the polyurethane pad 30. The recess 42 is defined by a marginal lip 44 surrounding an outer edge 46 of the bonding member 40.

Preferably, if the bonding member 40 is made from galvanized steel, the bonding member 40 is powder-coated with a coating composition 48 similar to one of the coating compositions disclosed in a copending application, U.S. patent application Ser. No. 08/116,758 (ITW Case 6842) which was filed on Sep. 7, 1993, by Fred A. Kish and Parimal Vadhar, which is entitled COATED FASTENER, which is assigned commonly herewith, and the disclosure of which is incorporated herein by reference. Preferably, the coating composition 48 comprises a polyester resin, as disclosed therein. Alternatively, the coating composition 48 comprises an epoxy or acrylic resin, as disclosed therein.

When the polyurethane pad 30 is cast onto the bonding member 40, the polyurethane pad 30 bonds chemically to the composition 48 coating the galvanized steel of the bonding member 40, whereby the lower surface 52 of the polyurethane pad 30 is bonded directly to the upper surface 54 of the separating pad 40 so as to resist relative movement between the bonding member 40 and the polyurethane pad 30. No separate adhesive is needed, therefore, to bond the polyurethane pad 30 to the bonding member 40.

Moreover, an adhesive layer 50 is used to bond the bonding member 40 to the concrete tie 14, at the lower surface 56 of the bonding member 40 and the upper surface 18 of the concrete tie 14, so as to resist relative movement between the bonding member 40 and the concrete tie 14 and so as to retard infiltration of sand, water, or debris between the bonding member 40 and the concrete tie 14.

Preferably, the adhesive layer 50 in its uncured state is deposited on the upper surface 18 of the concrete tie 14, whereupon the composite pad 10 is pressed onto the adhesive layer 50 so as to spread the adhesive layer 50 until the adhesive layer 50 covers the lower surface 56 of the bonding member 40 and the marginal lip 44. It is permissible for some of the adhesive layer 50 to be thus extruded beyond the marginal lip 44. Thereupon, the adhesive layer 50 is allowed to cure, until the bonding member 40 is bonded to the concrete tie 14.

Preferably, the adhesive layer 50 is comprised of a methacrylate ester composition, namely the methacrylate ester composition disclosed in a copending application, U.S. patent application Ser. No. 08/310,709 (ITW Case 7046) which was filed on Sep. 21, 1994, by Fred A. Kish et al. for A METHACRYLATE ESTER COMPOSITION FOR ANCHORING MATERIALS IN OR TO CONCRETE OR MASONRY, which is assigned commonly herewith, and the disclosure of which is incorporated herein by reference.

By this construction, any relative movement between the railroad rail 12 and the concrete tie 14 that is caused by a train rolling over the rail 12 will be between the bottom surface 58 of the rail flange 16 and the top surface 54 of the polyurethane pad 30.

Since the bonding member 40 is bonded directly to the polyurethane pad 30 and since the adhesive layer 50 bonds both to the bonding member 40 and to the concrete tie 14 so as to resist relative movement between the bonding member 40 and the concrete tie 14 and so as to retard infiltration of sand, water, or debris between the bonding member 40 and the concrete tie 14, the deterioration and erosion problems discussed above are alleviated, even under high loadings, in regions where weather conditions vary widely from summer to winter, at sharp curves, and at steep grades.

Various modifications may be made in the first and second embodiments described above without departing from the scope and spirit of this invention.

I claim:

1. In a railroad track, a combination comprising a railroad rail having a lower flange, a railroad tie made from concrete, and an elastomeric pad mounted between the lower flange of the railroad rail and an upper surface of the railroad tie, the elastomeric pad having an upper surface and a lower surface, the upper surface of the elastomeric pad underlying, engaging, and being in direct contact with the lower flange of the railroad rail, and means comprising a bonding member and an adhesive layer for bonding the elastomeric pad to the railroad tie, the bonding member having an upper surface bonded to the lower surface of the elastomeric pad so as to resist relative movement between the elastomeric pad and the bonding member, the adhesive layer comprising a methyacrylate ester composition and bonding the bonding member to the upper surface of the railroad tie, at the lower surface of the bonding member, so as to resist relative movement between the bonding member and the railroad tie and so as to retard infiltration of sand, water, or debris between the bonding member and the railroad tie, the combination permitting relative movement between the lower flange of the railroad rail and the elastomeric pad.

2. The combination of claim 1 wherein the bonding member is bonded directly to the elastomeric pad.

3. The combination of claim 2 wherein the elastomeric pad is cast onto the bonding member so that the bonding member is bonded directly to the elastomeric pad.

4. The combination of claim 2 wherein the elastomeric pad is cast onto the bonding member so that the bonding member is bonded directly to the elastomeric pad, in a recess in the elastomeric pad.

5. The combination of claim 2 wherein the elastomeric pad is a polyurethane pad cast onto the bonding member so that the bonding member is bonded directly to the polyurethane pad.

6. The combination of claim 2 wherein the elastomeric pad is a polyurethane pad cast onto the bonding member so that the bonding member is bonded directly to the polyurethane pad, in a recess in the polyurethane pad.

7. The combination of claim 1 wherein the bonding member is made from steel.

8. The combination of claim 7 wherein the bonding member is made from galvanized steel.

9. The combination of claim 8 wherein the bonding member is made from galvanized, powder-coated steel.

10. The combination of claim 9 wherein the bonding member is powder-coated with a coating composition comprising a polyester resin.

11. The combination of claim 9 wherein the bonding member is powder-coated with a coating composition comprising an epoxy resin.

12. The combination of claim 9 wherein the bonding member is powder-coated with a coating composition comprising an acrylic resin.

13. The combination of claim 1 wherein the bonding member is made from a polymeric material.

14. The combination of claim 13 wherein the bonding member is polycarbonate.

* * * * *

UNITED STATES PATENT AND TRADEMARK OFFICE

CERTIFICATE OF CORRECTION

PATENT NO. : 5,549,245

DATED : August 27, 1996

INVENTOR(S) : Frederick A. Kish

It is certified that error appears in the above-indentified patent and that said Letters Patent is hereby corrected as shown below:

Column 2, line 34, "he" should be --the--;

Column 3, line 2, "improve" should be --improved--; and

Column 4, line 11, "a" should be deleted.

Signed and Sealed this

Third Day of December, 1996

Bruce Lehman

*Attest:*

BRUCE LEHMAN

*Attesting Officer*

*Commissioner of Patents and Trademarks*